United States Patent [19]

Komaki

[11] 4,196,583

[45] Apr. 8, 1980

[54] ANALOGUE ELECTRONIC ALARM TIMEPIECE

[75] Inventor: Shojiro Komaki, Tokyo, Japan

[73] Assignee: Kabushiki Kaisha Daini Seikosha, Japan

[21] Appl. No.: 943,928

[22] Filed: Sep. 20, 1978

Related U.S. Application Data

[63] Continuation of Ser. No. 778,938, Mar. 18, 1977, abandoned.

[30] Foreign Application Priority Data

Mar. 19, 1976 [JP] Japan ..... 51-30432

[51] Int. Cl.[2] ..... G04B 27/08

[52] U.S. Cl. ..... 368/73; 368/74; 368/77; 368/80; 368/251; 368/87

[58] Field of Search ..... 58/23 R, 38 R, 57.5, 58/35 W, 16 R, 16 D, 85.5, 126 A, 125 B

[56] References Cited

U.S. PATENT DOCUMENTS

| | | | |
|---|---|---|---|
| 3,086,352 | 4/1963 | Jaccard | 58/57.5 |
| 3,538,703 | 11/1970 | Walton | 58/23 R |
| 3,664,117 | 5/1972 | McIntosh | 58/35 W |
| 3,775,967 | 12/1973 | Spadini | 58/57.5 |
| 4,040,248 | 8/1977 | Laesser | 58/38 R |

FOREIGN PATENT DOCUMENTS

| | | | |
|---|---|---|---|
| 1073400 | 6/1960 | Fed. Rep. of Germany | 58/38 R |
| 1344425 | 10/1963 | France | 58/38 R |

*Primary Examiner*—Ulysses Weldon

*Attorney, Agent, or Firm*—Robert E. Burns; Emmanuel J. Lobato; Bruce L. Adams

[57] ABSTRACT

An analogue electronic alarm timepiece has a dial on which time is displayed by the usual hour, minute and second hands. The time for which the alarm is set is displayed digitally in an aperture provided in the dial. The digital display of the alarm time is effected by means of a rotatable hour wheel having hour indicia thereon and a rotatable minute wheel having minute indicia. The hour wheel and minute wheel are selectively rotatable by manual operation of an external stem. The hour wheel and minute wheel are magnetically and electronically coupled with alarm time memory means. Time counting means is electronically connected with a dividing circuit which divides a standard signal produced by an oscillator and to which a motor for driving the hands is also connected. The alarm is activated by a coincidence circuit when the time of the time counting means coincides with the time for which the alarm time memory means is set. Means is provided for synchronizing the time counting circuit with the hands.

5 Claims, 5 Drawing Figures

ANALOGUE ELECTRONIC ALARM TIMEPIECE

This is a continuation of application Ser. No. 778,938, filed Mar. 18, 1977 now abandoned.

FIELD OF THE INVENTION

The present invention relates to an electronic alarm timepiece and particularly to an analogue timepiece in which time is displayed by means of a dial and movable hands while the time for which the alarm is set is displayed digitally in an aperture provided in the dial.

BACKGROUND OF THE INVENTION

Conventionally in an analogue electronic alarm timepiece in which time is displayed by means of hands and a dial the alarm setting means comprises an alarm setting hand. The alarm time is set by setting the alarm hand on the dial.

However such an arrangement is disadvantageous in that it is difficult to set an analogue electronic timepiece so as to produce an alarm sound at a precise time, for example 12 hours, 00 minutes and 00 seconds.

SUMMARY OF THE INVENTION

It is an object of the present invention to provide an analogue electronic alarm timepiece eliminating the above mentioned disadvantages by providing means for displaying the alarm time digitally. It is another object of this invention to provide an electronic timepiece having a memory in conjunction with a digital time indication in an aperture portion of the dial.

A further object of this invention is to provide an analogue electronic alarm timepiece having a time counting circuit coupled with means for driving the time display hands, an alarm time memory circuit coupled with the digital alarm time display means and a coincidence circuit for activating an alarm sound generating means when coincidence occurs between the time of the time counting circuit and the set time of the alarm time memory circuit.

Still a further object of the invention is to provide an analogue electronic alarm timepiece having a one chip intergrated circuit including an hour counter, minute counter and other electronic circuitry.

A further object of the invention is to provide an analogue electronic alarm timepiece in which time setting means and alarm time setting means including a digital alarm time display can be operated readily, for example by means of the stem of the timepiece.

In the embodiments of the invention herein shown by way of example time is displayed by the position of the hands on the dial while the alarm time is determined by electronic circuitry comprising an alarm time memory circuit and a time counting circuit. Since the position of the hour and minute hands on the dial is not determined by the time counting circuit the contents of hour and minute counters do not necessarialy coincide with the time shown by the hands of the timepiece on the dial. However the alarm such as a buzzing sound must be produce when the time shown by the hour and minute hands coincides with the alarm time digitally displayed in the aperture portion of the dial. It is accordingly another object of the invention to provide means for synchronizing the hands of the timepiece with the time counting circuit and coupling the alarm time memory circuit with the digital alarm time display means so that the alarm is activated when the hands of the timepiece indicate exactly the time displayed by the digital alarm time display means.

A further feature of the invention is that the dividing circuit, the hour and minute counters and the memory circuit corresponding to the hour and minute counters are connected to the common lines of a resetting circuit so that all are reset simultaneously. The resetting circuit for the dividing circuit is made to operate at the time the stem is pulled out in order to rotate the hour and minute hands so as to make a time adjustment so that the hour and minute hands are stopped by the resetting of the dividing circuit. In accordance with the invention the hour and minute counters and the alarm time memory circuit are reset at the same time.

BRIEF DESCRIPTION OF THE DRAWINGS

The nature, objects and advantages of the invention will be more fully understood from the following description of preferred embodiments in conjunction with the accompanying drawings in which.

DESCRIPTION OF PREFERRED EMBODIMENTS

Figure 1A:
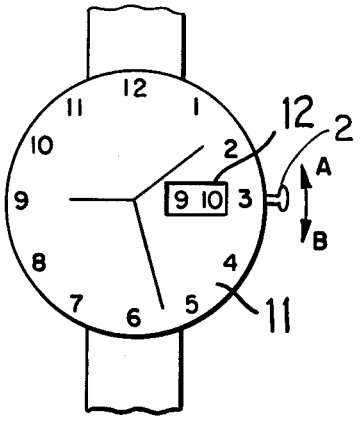
FIG. 1A is a schematic front view of the dial of an electronic timepiece in accordance with the present invention.

Referring now to an embodiment of the invention shown by way of example in the drawings, FIG. 1A shows the dial of the analogue electronic timepiece with means for digitally displaying the alarm time. The alarm setting time of 9 hours 10 minutes is displayed digitally in the aperture portion 12 of the dial 11.

In order to have the alarm occur at the intended time as indicated by the hour and minute hands synchronization is required between the alarm setting indication and the indicating hands which are shown in FIG. 1A as indicating the time of about 9 hours 8 minutes. Shortly before a time information instrument such as a radio informs the user of the precise time of 9:10, the user selects the numeral 9 indicating 9 hours by rotating the stem 2 in the direction of the arrow A. Next the user selects the numeral 10 indicating 10 minutes by rotating the stem 2 in the direction of the arrow B. Thereafter by pulling out the stem 2 the time hands are adjusted to the time of 9 hours 10 minutes 00 seconds. The user then pushes in the stem to make the time hands start at the exact time of the time anouncement of the radio or the like informing the user that the time is 9 hours 10 minutes 00 seconds. Synchronization between the time hands and the indication for setting the alarm is completed by this operation.

Figure 1B:
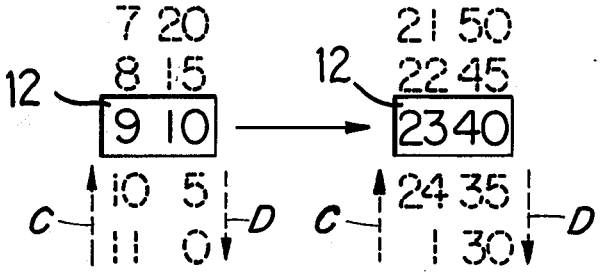
FIG. 1B is a schematic diagram showing the method of setting the alarm time.

Next assuming that the user wishes to set the alarm time of 23 hours 40 minutes, he selects the digital indication of 23 hours by rotating the stem in the direction of the arrow A and next he selects the digital indication of 40 minutes by rotation of the stem in the direction of the arrow B so that the digital indication of 23 hours and 40 minutes is shown in the aperture portion 12, as illustrated in FIG. 1B. Thus the alarm time setting is effected merely by rotating the stem first in one direction and then in the opposite direction.

When the time adjustment is made the contents of the hour counter, minute counter and dividing circuit are reset to a constant value if the hour counter, minute counter and dividing circuit have common resetting means. On the other hand the user makes the time which the hour, minute and second hands indicate coincide with the time as shown in the aperture portion of the dial by operation of the stem and thereafter makes the timepiece circuit start simultaneously with the starting of the time indicating hands.

At this time the alarm sound is produced since the contents of the minute and hour memory circuits coincide with the contents of the minute and hour counter. Accordingly the user is able to confirm proper operation of the alarm circuit. The stopping action of the alarm is made in the same manner as that of the conventional alarm.

Figure 1C:
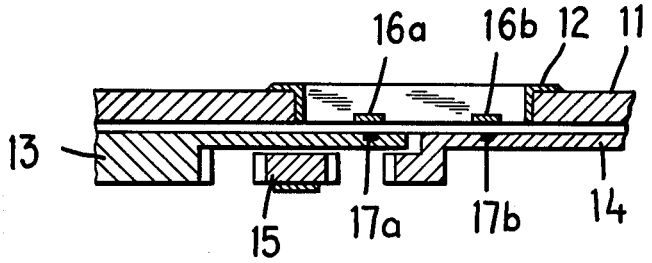
FIG. 1C is a schematic cross sectional view of the setting mechanism for the alarm time.

FIG. 1C shows a schematic cross sectional view of the setting mechanism for the alarm setting time. An hour setting toothed wheel 13 and minute setting toothed wheel 14 are rotatably mounted below the dial 11 and carry hour indicia and minute indicia respectively which are visible through the aperture portion 12 of the dial. The toothed wheels 13 and 14 are constructed so as to be selectively rotatable by the hour and minute rotor 15 upon operation of the stem 2. Thus the hour indicia provided on the face of the hour setting toothed wheel 13 move in the direction shown by the arrow C in FIG. 1B if the stem is rotated in the direction of the arrow A in FIG. 1A. The minute indicia provided on the face of the minute setting toothed wheel 14 move in the direction indicated by the arrow D in FIG. 1B if the stem is rotated in the direction shown by the arrow B in FIG. 1A.

At the same time magnetic material **17*a* provided on the hour setting wheel 13 and corresponding to the hour indicia are detected by Hall elements 16*a* provided in the side wall of the aperture portion 12 of the dial to confirm the number of the hour indication. In the same manner the Hall element 16*b* detects the magnetic material 17*b* corresponding to the minute indication on the minute setting wheel 14 and generates an electrical signal upon rotation of the stem in the direction of arrow B in FIG. 1A so as to make the minute setting tooth wheel 14 rotate in the direction of the arrow D in FIG. 1B**.

Figure 2:
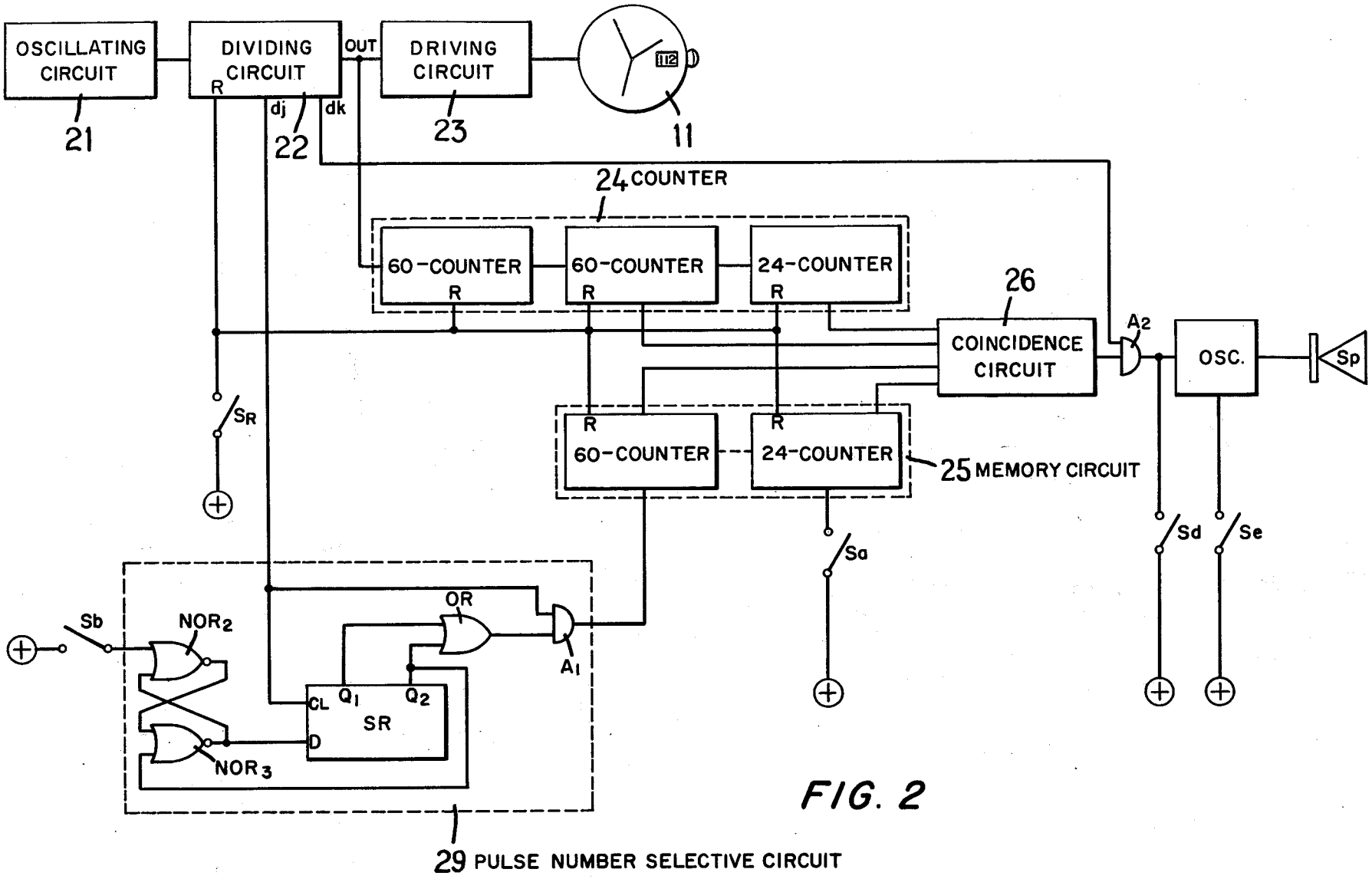
FIG. 2 is a circuit diagram of the timepiece circuit of an electronic timepiece in accordance with the invention.

Next the timepiece circuit of one embodiment of this invention as shown in FIG. 2 will be described.

In the circuitry of FIG. 2 the standard time signal of the oscillating circuit 21 having a quartz crystal vibrator is converted to a 1 Hz signal by a dividing circuit 22 and this 1 Hz signal is applied to the driving circuit 23 so as to drive the time hands on the dial.

This 1 Hz signal is also applied to the 60-counter for seconds which is connected to the 60-counter for minutes which is connected in turn to the 24-hour counter for hours of a time counting circuit 24. On the other hand there is a corresponding alarm time memory circuit 25 including a 60-counter for memorizing the minutes and a 24-counter for memorizing the hours.

A switch Sa is connected to the input terminal of the 24-counter memorizing the hours of the alarm time memory circuit 25. This switch Sa corresponds to the Hall element **16*a* as shown in FIG. 1C and is the equivalent switch which comes to be in the ON state when the magnetic material 17*a* corresponding to a numeral on the hour setting wheel passes the aperture portion 12 of the dial 11 during rotation of the stem in the direction of the arrow A shown in FIG. 1A**.

The input terminal of the 60-counter of the alarm time memory circuit 25 for storing minutes is connected to the pulse number selective circuit 29. The circuit 29 comprises NOR circuits NOR2 and NOR3, a shift register SR having two output terminals Q1 and Q2 which are connected through an OR circuit OR to an AND circuit A1. The dividing stage output dj of the dividing circuit 22 is used as the input signal fed to the clock terminal CL of the shift register SR. A switch Sb is connected through NOR circuits NOR2 and NOR3 to the input D of the shift register SR. The switch Sb corresponds to the Hall element **16*b* as shown in FIG. 1C and the opening and closing of the switch Sb is actuated by the magnetic material 17*b* corresponding to the position of the minute indications on minute setting wheel 14. Assuming now that the stem rotates in the direction of the arrow B in FIG. 1A the equivalent switch Sb of FIG. 2 is closed upon the detection by the Hall element 16*b* of the magnetic material 17*b* on minute setting wheel 14 as shown in FIG. 1C**.

Accordingly the flipflop including the NOR circuit NOR2 and the NOR circuit NOR3 is inverted and the output signal of the flipflop is fed to the shift register SR. The two pulses of the dividing stage dj used as the clock signal for the shift register SR are applied to the minute memory counter through the AND gate A1 circuit each time the switch Sb is closed. The minute memory counter of the alarm time memory circuit 25 thus receives two pulses on each switching action of the switch. Hence the minute setting wheel 14 is calibrated in two minute intervals so that for 60 minutes thirty indicia are required.

Also in the circuit of the embodiment shown in FIG. 2 there is a coincidence circuit 26 which detects coincidence between the memory circuit 25 having an hour memory counter and a minute memory counter and the time counter 24 having an hour counter and a minute counter. An oscillating circuit OSC is controlled by the output signal of an AND gate A2, one input terminal of which is connected to the output of the coincidence circuit 25 while the other input is connected to an output dk of the dividing circuit 22. Hence an audible sound is produced by the speaker SP when coincidence occurs between the memory circuit 25 and the time counting circuit 24. Switch Sd is used to produce the audible sound of the speaker Sp which receives the electric signal of the oscillating circuit OSC. There is also provided a switch Se which is used to stop the production of audible sound by stopping the action of the oscillating circuit OSC.

Referring now to the setting of the alarm time the switch SR is closed by pulling out the winding stem. The dividing circuit 22, the respective counters of the time counter 24 and the respective counters of the memory counter 25 are reset by the closing of the switch Sr.

It is assumed that the timepiece including the oscillating circuit 21, the dividing circuit 22 and the driving circuit 23 is operated in normal operation which is not in either of the retarded state or advanced state.

The switch for resetting the dividing circuit 22 may be disposed independently of the switch for resetting the memory circuit 25 if a time error between the alarm setting time and the buzzing time of the alarm is allowed.

In this case the user knows the time showing by the time hands on the dial is 9 hours and 8 minutes. He then rotates the winding stem as described above so that both the hour indication of "9" and the minute indication of "8" are set in the aperture portion 12 of the dial. After setting, the time counter 24 and memory circuit 25 are reset by the resetting switch independent of the resetting of the dividing circuit 22. The alarm setting time, for example of 23 hours and 40 minutes is then set by operation of the winding stem as described above.

In the event that the dividing circuit 22, time counter 24 and memory circuit 25 as shown in FIG. 2 are reset in common, the hour indication and minute indication are set to the expected time of a precise time announcement, for example on the radio, for example of 9:10 by rotating the winding stem. Namely the respective hour indication and minute indication are set to the numeral 9 and numeral 10 respectively. Next the dividing circuit 22, the counter 24 and the memory circuit 25 are reset by closing the switch SR by pulling out the stem. Then the hour hand on the dial is set to 9 hours and the minute hand is set to 10 minutes and the second hand is set to 00 seconds. When the expected time announcement of 9 hours 10 minutes and 00 seconds is made the user pushes in the stem so as to start the driving of the hands and also start the counting by the time counting circuit 24.

As soon as the dividing circuit 22, the counter 24 and the memory circuit 25 stop resetting the coincidence circuit 26 operates at the time of 23 hours and 40 minutes if the memory circuit 25 accumulates the alarm setting time of 23 hours 40 minutes. Accordingly the speaker Sp produces an audible sound. Thereafter the alarm set has only to set the desired alarm time since the counter 24 is synchronized with the memory circuit 25.

Figure 3:
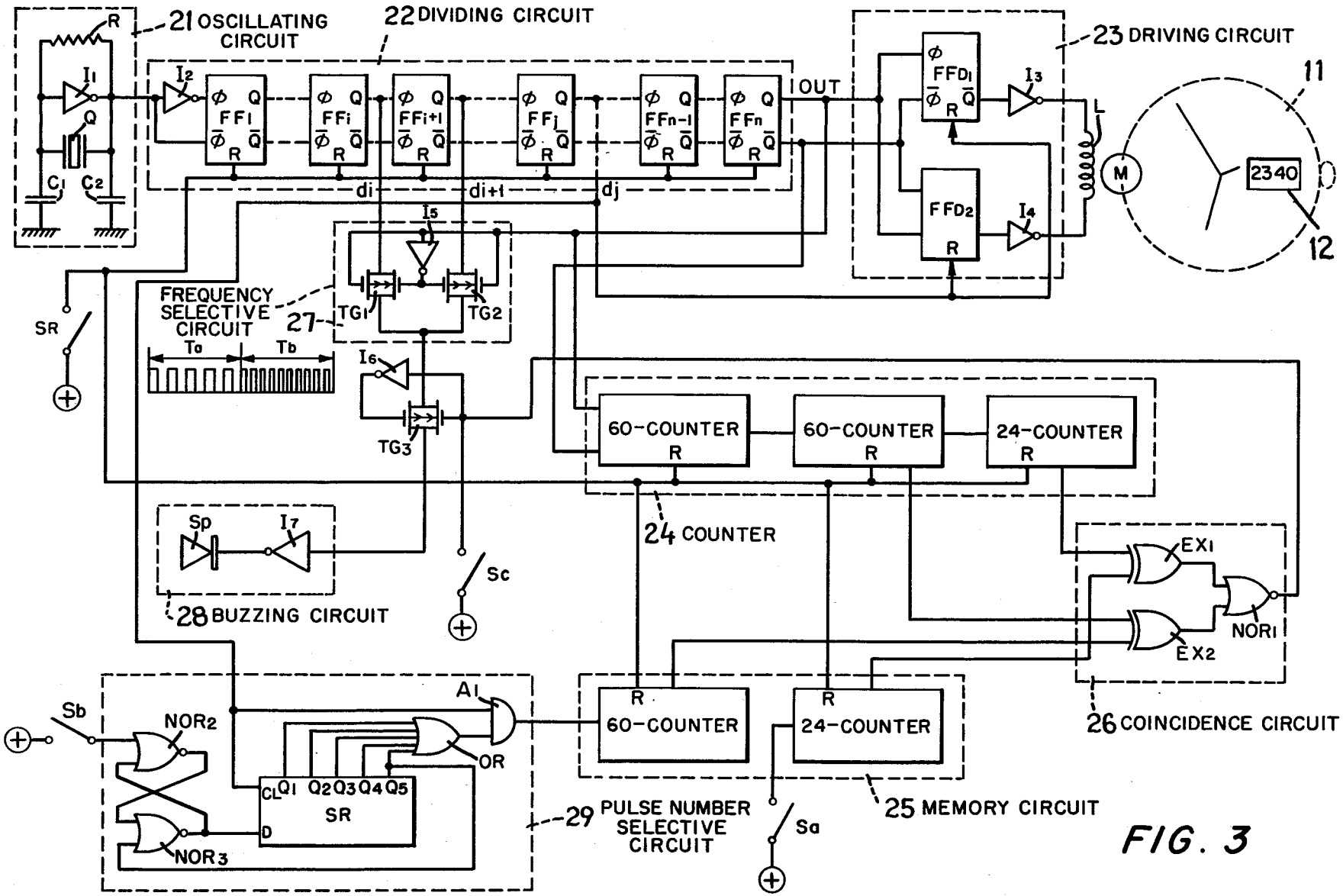
FIG. 3 is a circuit diagram of another embodiment.

Referring next to another embodiment of the invention as shown in FIG. 3 the oscillating circuit 21 is a Colpitts type oscillating circuit comprising a quartz crystal vibrator Q, an invertor $I_1$ and capacitor $C_1$, $C_2$. The dividing circuit 22 comprises flipflops $FF_1$–$FF_n$. The driving circuit 23 including the flipflops $FFD_1$ and $FFD_2$ is connected to the dividing circuit 22 and the motor M is driven by energization of the driving coil L.

The dividing circuit 22 is connected to the counter 24 in the same manner as in the embodiment shown in FIG. 2 and the memory circuit 25 corresponds to the time counter 24.

The hour memory circuit receives electric signals derived from the Hall element 16*a* as shown in FIG. 1C and also the minute memorizing circuit receives the output signal of the pulse number selective circuit 29 having a 5-bit shift register SR.

As to the difference between the embodiment of FIG. 2 and that of FIG. 3, the five pulses derived from the AND gate A1 are applied to the minute memory circuit at each closing of the switch Sb equivalent to the Hall element. Accordingly the minute indication is indicated at 5 minute intervals.

Also in the embodiment of FIG. 3 the transmission gate $TG_3$ is controlled by the output signal of the coincidence circuit 26. The transmission gate $TG_3$ comes to be in the conductive state upon receiving a coincidence signal from the coincidence circuit 26. Accordingly the frequency selecting circuit 27 is actuated by the output signal of the dividing circuit 22. The buzzing circuit 28 is provided with output signals di and di+1 of the dividing stage whereby the speaker produces an audible sound. The stopping of the audible sound may be effected by connecting the mono-stable multivibrator to the coincidence circuit 26. Also the switch Sc is used to confirm the buzzing sound by the user.

Further the alarm time setting is made in the same manner as in the embodiment shown in FIG. 2.

As mentioned above in accordance with this invention the alarm setting time may be set by the alarm setting indication digitally in the analogue electronic timepiece. Furthermore the analogue electronic timepiece according to this invention does not require an increase in mechanical parts more than the conventional electronic timepiece since the alarm setting time is executed by the hour setting toothed wheel and minute setting toothed wheel in conjunction with the winding and setting stem.

In the circuit of FIGS. 2 and 3 it is advantageous that the alarm time is set with the winding stem if the time counter 24 is synchronized with the memory circuit 25. Accordingly the synchronization between the time counter 24 and memory circuit 25 is preferably executed at the time of the time adjustment.

Also the hour toothed wheel may be independent of the minute toothed wheel in rotational direction if the minute counter and the hour counter of the memory circuit 25 is an up-down counter. In accordance with this construction the operation of setting the alarm time can be readily effected. Further more the hour indication for setting the alarm time may be a 24 hour indication. The minute indication is preferably in the range of a 2 minute interval to a 5 minute interval. This is determined by the number of outputs of the shaft register in the pulse number selecting circuit 29.

The production of the embodiments shown in FIGS. 2 and 3 may be readily executed since the time counter 24 memory circuit 25 and pulse number selecting circuit 29 are made of field effect transistors and these circuits together with oscillating circuit 21, dividing circuit 22 and driving circuit 23 can be integrated monolithically.

In accordance with the invention the resetting action by which the contents of the time counter 24 coincides with the contents of the memory circuit 25 when the alarm setting time is synchronized with the time indicated on the dial by the hands can be confirmed since the coincidence circuit acts so that the speaker produces an alarm sound. The pulse number selecting circuit is able to use the second counter of the counter.

While preferred embodiments of the invention have been illustrated in the drawings and are herein particularly described it will be understood that many variations and modifications can be made and that hence the invention is in no way limited to the illustrated embodiments.

What is claimed is:

1. An analogue electronic alarm timepiece comprising a calibrated dial having an aperture therein, hands movable relative to said dial to indicate time, electronic circuit means comprising oscillator means for generating a standard signal, frequency dividing means for dividing said signal, motor means energized by said dividing means for dividing said hands, alarm means including alarm sound generating means, alarm time memory means, time counting means for counting signals received from said dividing means, coincidence means connected with said alarm time memory means and said time counting means for energizing said alarm sound generating means when coincidence occurs between the time of said time counting means and the set time of said alarm time memory means, means for setting said alarm time memory means and for digitally displaying in said aperture in the dial the alarm time for which said alarm time memory means is set, said alarm time setting and display means comprising a rotatable hour wheel having thereon hour indicia displayable through said aperture in the dial, a rotatable minute wheel having thereon minute indicia displayable through said aperture in the dial, and means activated by rotation of said hour wheel and minute wheel to set said alarm time memory means.

2. An analogue electronic alarm timepiece according to claim 1, in which said digital alarm time display means comprises a 24 hour display.

3. An analogue electronic alarm timepiece according to claim 1, in which said digital alarm time display means comprises means for displaying minutes in units of 2 to 5 minutes.

4. An analogue electronic alarm timepiece according to claim 1, comprising means for simultaneously resetting said dividing means said time counting means and said alarm time memory means.

5. An analogue electronic alarm timepiece according to claim 1, in which said alarm time setting means comprises magnetic material on said hour and minute wheels and means for detecting passage of said magnetic material as said wheels are rotated.

* * * * *